US007128581B2

(12) United States Patent
Igarashi et al.

(10) Patent No.: US 7,128,581 B2
(45) Date of Patent: Oct. 31, 2006

(54) CONNECTOR FOR CONNECTING CIRCUIT BOARDS

(75) Inventors: Minoru Igarashi, Inzai (JP); Seiji Shishikura, Chiba (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/619,489

(22) Filed: Jul. 16, 2003

(65) Prior Publication Data

US 2004/0014335 A1 Jan. 22, 2004

(30) Foreign Application Priority Data

Jul. 18, 2002 (JP) ..... 2002-210189

(51) Int. Cl.
*H01R 12/00* (2006.01)

(52) U.S. Cl. ..... 439/74; 439/660

(58) Field of Classification Search ..... 439/74, 439/563, 660
See application file for complete search history.

(56) References Cited

U.S. PATENT DOCUMENTS 5,120,256 A * 6/1992 Walden ..... 439/553
5,183,405 A * 2/1993 Elicker et al. ..... 439/108
5,626,482 A * 5/1997 Chan et al. ..... 439/74
5,915,976 A * 6/1999 McHugh ..... 439/74
5,928,003 A * 7/1999 Kajinuma ..... 439/74
5,931,689 A * 8/1999 Patel ..... 439/346
6,132,258 A * 10/2000 Kajinuma ..... 439/660
6,645,005 B1 * 11/2003 Wu ..... 439/563

FOREIGN PATENT DOCUMENTS

| | | |
|---|---|---|
| JP | 05-002385 | 1/1993 |
| JP | 06-048181 | 6/1994 |
| JP | 9-266037 | 10/1997 |
| JP | 10-050371 | 2/1998 |
| JP | 11-074024 | 3/1999 |
| JP | 11-204181 | 7/1999 |
| JP | 2001-057273 | 2/2001 |

OTHER PUBLICATIONS

Official Notice issued by the Japanese Patent Office in Japanese Patent Application No. 2002-210189, dated May 28, 2004.
Official Notice of Rejection from Japanese Patent Office, Patent Application No. 2002-210189, mailed Mar. 29, 2005.

* cited by examiner

*Primary Examiner*—Thanh-Tam Le
(74) *Attorney, Agent, or Firm*—Finnegan, Henderson, Farabow, Garrett & Dunner, LLP

(57) ABSTRACT

A male connector section is held on a female connector section by the engagement of nibs in the metallic holding fixture with projections of the metallic holding fixture in the female connector section.

3 Claims, 13 Drawing Sheets

CONNECTOR FOR CONNECTING CIRCUIT BOARDS

This application claims priority from Japanese Patent Application No. 2002-210189 filed Jul. 18, 2002, which is incorporated hereinto by reference.

BACKGROUND OF THE INVENTION

1. Field of the Invention

The present invention relates to a connector for electrically connecting circuit boards to each other.

2. Description of the Related Art

A plurality of printed wiring boards forming digital circuits are built-in within a relatively narrow space in an electronic equipment such as a cellular phone. The plurality of printed wiring boards are mutually connected electronically, for example, via a connector for connecting the circuit boards.

As shown in FIG. 9, the connector for connecting the circuit boards is comprised of a male connector section 4 disposed on a first printed wiring board 2 and a female connector section 6 disposed on a second printed wiring board 8 opposite to the first printed wiring board 2.

The male connector section 4 has, as main constituent elements, a base 4M molded of resinous material, and contact terminals 4Ai and 4Bi (i=1 to n; n is a positive integer) arranged at a predetermined distance on both ends of longer sides of the base 4M, respectively, to be electrically connected at one ends thereof to the respective electrodes of the first printed wiring board 2.

In a region between the contact terminals 4Ai and 4Bi in the base 4M, recesses 4*a* and 4*b* are formed at a predetermined distance between the both, to be engaged with projections 6*a* and 6*b*, respectively, of a connector section 6 described later.

Further, on each of both ends of shorter sides of the base 4M, a pair of nibs 4Na, 4Nb are provided. The pair of nibs 4Na, 4Nb are molded of resinous material to be integral with the base 4M. The pair of nibs 4Na, 4Nb are selectively engaged with the outer edge of through-holes 6Ha, 6Hb, respectively, of the female connector section when assembled to the female connector section 6.

The female connector section 6 has, as main constituent elements, a box-like base 6M having an accommodation portion for accommodating the base 4M of the male connector section 4 and the contact terminals 4Ai and 4Bi, and contact terminals 6Ai and 6Bi (i=1 to n; n is a positive integer) arranged at a predetermined distance on both ends of longer sides of the base 6M, respectively, to be electrically connected at one ends to the respective electrodes of the second printed wiring board 8.

Projections 6*a*, 6*b* are spaced at a distance in a region of the accommodation portion within the base 6M between the contact terminals 6Ai and 6Bi, to be engaged with the recesses 4*a* and 4*b* of the base 4M described above.

On the both ends of shorter sides of the base 6M, through-holes 6Ha and 6Hb are formed to be engageable with the pair of nibs 4Na and 4Nb when the male connector section 4 is assembled.

When this male connector section 4 is assembled to the female connector section 6 so that the first printed wiring board 2 is electrically connected to the second printed wiring board 8, as shown in FIGS. 10, 11 and 12, base 4M of the male connector section 4 is press-fit into the accommodation portion of the base 6M against the mutual elastic force between the contact terminals 4Ai, 4Bi and the contact terminals 6Ai, 6Bi. At this time, the recesses 4*a* and 4*b* in the base 4M are engaged with the projections 6*a* and 6*b*, respectively, as well as the pair of nibs 4Na and the pair of nibs 4Nb are engaged with the periphery of the through-holes 6Ha and the through-holes 6Hb, respectively, whereby the male connector section 4 is held by the female connector section 6.

When the assembly of the male connector section 4 and the female connector section 6 is built-in in the electronic equipment such as a cellular phone, in which the first printed wiring board 2 and the second printed wiring board 8 are electrically connected to each other as described above, there is a risk in that the male connector section 4 comes off from the female connector section 6 when an electronic equipment is subjected to the action of an impactive force caused by the dropping thereof.

This is because, as shown in FIG. 13 in an enlarged scale, the size of the engagement area between the nibs 4Na, 4Nb and the peripheries of the through-holes 6Ha, 6Hb, respectively, is designed to be relatively small for enhancing ease of the attachment/detachment of the male connector section 4 from the female connector section 6. Also, the pair of nibs 4Na and 4Nb molded of resinous material to be integral with the base 4M may readily deform by the impactive force, respectively.

Further, there is a risk in that the male connector section 4 does not securely keep hold of the female connector section 6 each other, since the nibs 4Na and 4Nb molded of resinous material are worn when the attachment/detachment described above is repeated.

SUMMARY OF THE INVENTION

In view of the above problems, an object of the present invention is to provide a connector for connecting circuit boards with each other, capable of firmly holding a plurality of circuit boards electrically connected with each other even if a predetermined shock is applied thereto as well as excellent in resistance to abrasion against the repeated attachment/detachment between the connector sections.

To achieve the above object, according to the present invention, a connector for connecting circuit boards with each other is provided, comprising, a first connector section disposed on a first circuit board and having contact terminals electrically connected to electro-conductive layer of the first circuit board, and a second connector section disposed on a second circuit board provided in relation to the first circuit board and having contact terminals electrically connected to electro-conductive layer of the second circuit board with the contact terminals connected electrically to the contact terminal of the first connector section, wherein when the first connector section is coupled to the second connector section, metallic engaging portions provided in the first connector section are engaged with metallic portions being engaged having the elasticity provided in the second connector section to hold the first connector section on the second connector section.

As apparent from the above description, according to the inventive connector, since the metallic engaging sections provided in the first connector section are engaged with the metallic engaged sections provided in the second connector section when the first connector is coupled to the second connector, it is possible to assuredly hold a plurality of circuit boards electrically connected to each other even if a shock is applied to the connector. In addition, the inventive connector is excellent in resistance to abrasion against the repeated attachment/detachment between the connector sections.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
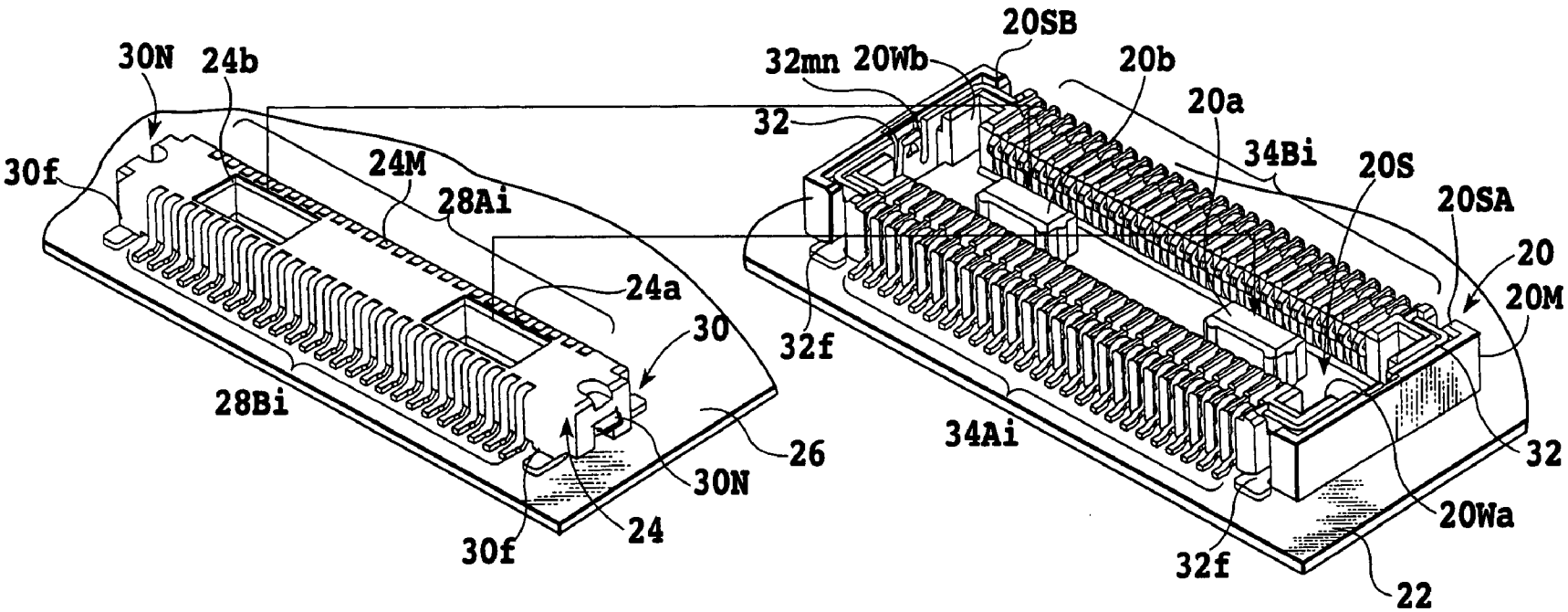
FIG. 1 is an exploded perspective view of one embodiment of a connector for connecting circuit boards with each other, together with circuit boards.

FIG. 1 illustrates one embodiment of the connector for electrically connecting circuit boards according to the present invention, together with the wiring boards to be connected each other.

For example, as shown in FIG. 1, the connector for connecting circuit boards is comprised of a male connector section 24 disposed on a first printed wiring board 26 and a female connector section 20 disposed on a second printed wiring board 22 facing the first printed wiring board 26.

The male connector section 24 is mainly comprised of a base 24M molded of resinous material and a plurality of contact terminals 28Ai and 28Bi (i=1 to n; n is a positive integer) arranged at a predetermined distance on both ends of longer sides of the base 24M, respectively to be electrically connected at one ends thereof to the respective electrodes of the first printed wiring board 26.

Recesses 24*a* and 24*b* are formed in a region of the base 24M between the contact terminals 28Ai and 28Bi apart from a predetermined distance relative to each other, to be engaged with projections 20*a* and 20*b*, respectively, of the connector section 20 described later.

Figure 2A:
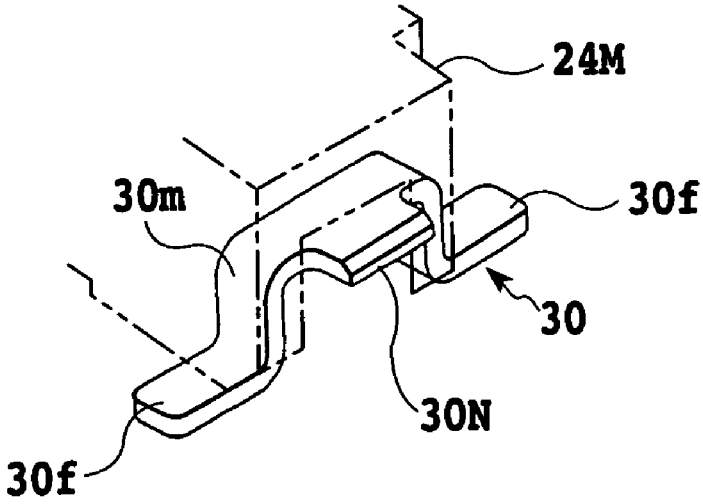
FIGS. 2A and 2B are perspective views, respectively, of holding fixture used in the embodiment shown in FIG. 1.

Further, as shown in FIG. 1, holding fixture 30 having nibs 30N are press-fit into recesses, respectively, formed within the both ends of shorter sides of the base 24M. As shown in FIG. 2A, the holding fixture 30 includes an fitting portion 30*m* of a rectangular shape formed, for example, of a metal sheet material to be press-fit into the recess and a pair of leg sections 30*f* contiguous to opposite ends of the fitting portion 30*m* to be fixed to the printed wiring board 26. At both ends of the fitting portion 30*m*, a nibs 30N are formed in such a manner as to project outward through a notch of the base 24M. The nib 30N as a engaging portion is engageable with an elastic piece 32*mr* as a portion being engaged of the holding fixture 32 described later when the male connector section 24 is assembled to the female connector section 20.

The contact terminals 28Ai and 28Bi are spaced, for example, approximately 0.4 mm apart. The other end of the respective contact terminal 28Ai, 28Bi extends along a side surface of the base 24M and reaches a top surface thereof. On the other hand, the one end of the respective contact terminal 28Ai, 28Bi is fixed to the electrode of the printed wiring board by the soldering.

The female connector section 20 is mainly comprised of a base 20M having an accommodation portion 20S for accommodating the base 24M and the contact terminals 28Ai and 28Bi of the male connector section 24 described above, and a plurality of contact terminals 34Ai and 34Bi (i=1 to n; n is a positive integer) arranged at a predetermined distance on both ends of longer sides of the base 20M, respectively to be electrically connected at one ends thereof to the respective electrodes of the second printed wiring board 22.

Projections 20*a* and 20*b* are provided apart from each other within a region of the accommodation portion 20S in the base 20M molded of resinous material between the contact terminals 34Ai and 34Bi, to be engaged with the recesses 24*a* and 24*b*, respectively, of the base 24M described before.

Figure 5:
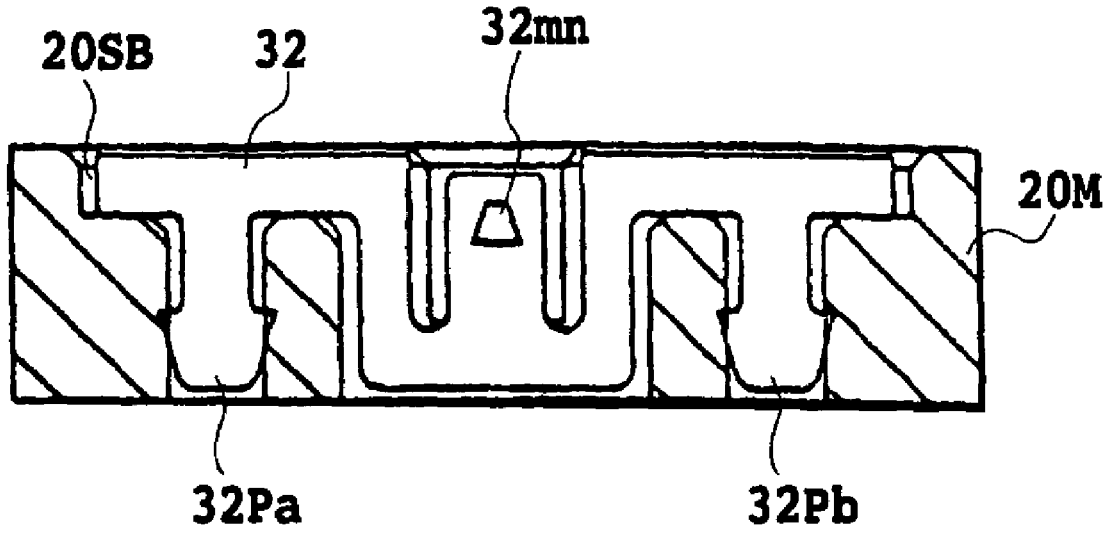
FIG. 5 is a sectional view taken along a line V—V in FIG. 3.

On the both ends of shorter sides of the accommodation portion 20S in the base 20M, inner walls 20*wa* and 20*wb* are formed, respectively. The inner walls 20*wa*, 20*wb* are formed in such a manner as to enclosing the accommodation portion 20S between ends of the contact terminals 34Ai, 34Bi and an outer walls of the base 20M along the outer walls. Between the inner walls 20*wa* and 20*wb* and the outer walls, grooves 20SA and 20SB are formed, respectively. As shown in FIG. 5, the holding fixture 32 are press-fit into the grooves 20SA and 20SB, respectively, so that the projections 32*mn* are opposite to each other.

Figure 2B:
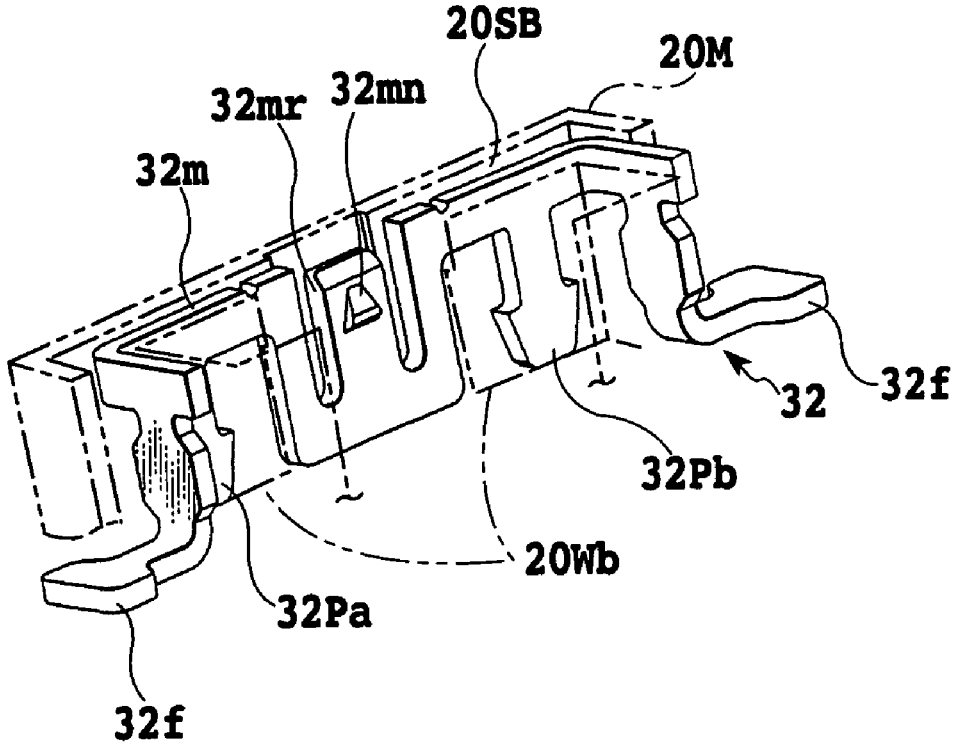

As shown in FIG. 2B, the rectangular-shaped holding fixture 32 made of metal sheet material includes an fitting portion 32*m* press-fit into the groove 20SA, 20SB and leg portions 32*f* extending from opposite ends of the fitting portion 32*m* in a bent manner to be fixed to the printed wiring board 22.

At a center of the fitting portion 32*m*, an elastic piece 32*mr* is formed. A proximal end of the elastic piece 32*mr* is coupled to the fitting portion 32*m*, and the other end of the elastic piece 32*mr* is freely deformable due to its elasticity to a predetermined extent. On the inner surface of the elastic piece 32*mr*, the projection 32*mn* as a portion being engaged is formed to be selectively engageable with the nib 30N described above. The projection 32*mn* and the elastic piece 32*mr* are exposed to the interior of the accommodation portion 20S through the notch formed in each of the inner walls 20*wa* and 20*wb*. In this regard, in the outer wall of the base 20M at a position opposite to the elastic piece 32*mr*, a recess is formed for allowing the elastic piece 32*mr* to advance/retract when the connector for connecting circuit boards is mounted or dismounted.

Projected pieces 32*pa* and 32*pb* are formed while intervening the elastic piece 32*mr* in a region of the fitting portion 32*m* adjacent to the elastic piece 32*mr*.

Figure 3:
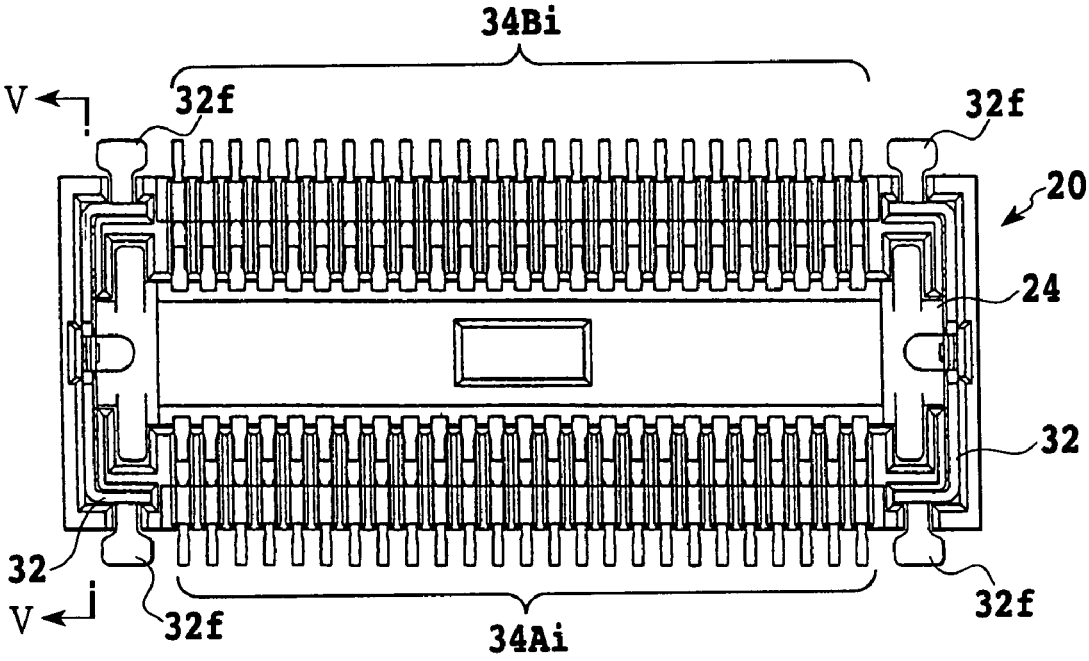
FIG. 3 is a plan view of a male connector section and a female connector section assembled to each other in the embodiment shown in FIG. 1.
Figure 4:
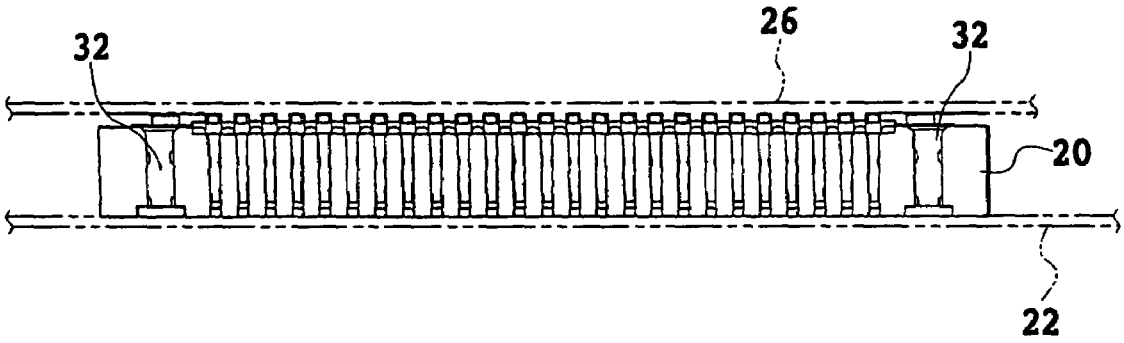
FIG. 4 is a front view of the assembly shown in FIG. 3.
Figure 6:
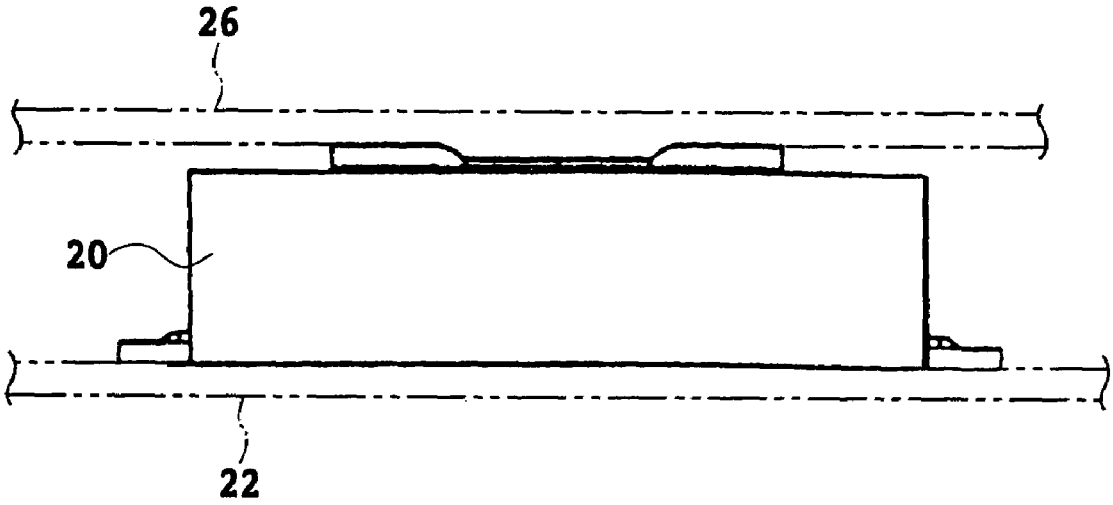
FIG. 6 is a side view of the assembly shown in FIG. 3.

When the male connector section 24 of the above-mentioned structure is assembled to the female connector section 20 to electrically connect the first printed wiring board 26 with the second printed wiring board 22 via the inventive connector, as shown in FIGS. 3, 4 and 6, the base 24M of the male connector section 24 is press-fit into the accommodation portion 20S of the base 20M against the mutual elastic force between the contact terminals 28Ai, 28Bi and the contact terminals 34Ai, 34Bi. At this time, recesses 24*a* and 24*b* of the base 24M are engaged with the projections 20*a* and 20*b*, respectively, as well as the nibs 30N are engaged with the projections 32*mn* after flexing the elastic pieces 32*mr* while sliding on the projections 32*mn*. Thus, the male connector section 24 is held on the female connector section 20.

On the other hand, when the male connector section 24 is separated from the female connector section 20, after the projections 32*mn* of the elastic pieces 32*mr* have been disengaged from the respective nibs 30N by forcibly flexing the respective elastic pieces 32*mr* in the engaged state to the recess side of the outer walls, the male connector section 24 and the female connector section 20 are pulled apart each other, thus the male connector section 24 is detached from the female connector section 20.

Since the projections 32*mn* of the elastic pieces 32*mr* in the holding fixture 32 and the nibs 30N of the holding fixture 30 are made of metallic material, there is no risk in that the projections 32*mn* of the elastic pieces 32*mr* and the nibs 30N are easily deformed by the applied impact. As a result, according to the one embodiment of the connector according to the present invention, even if a predetermined impact is applied thereto, it is possible to ensure the electric connection between a plurality of circuit boards, which connector is excellent in resistance to abrasion against the repeated attachment/detachment between the connector sections.

Figure 7:
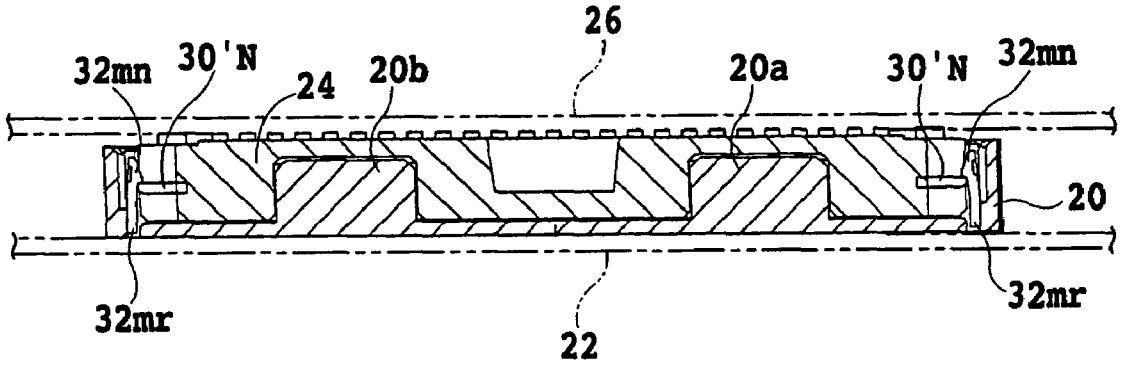
FIG. 7 is a sectional view of another embodiment of the connector for connecting circuit boards according to the present invention.
Figure 8:
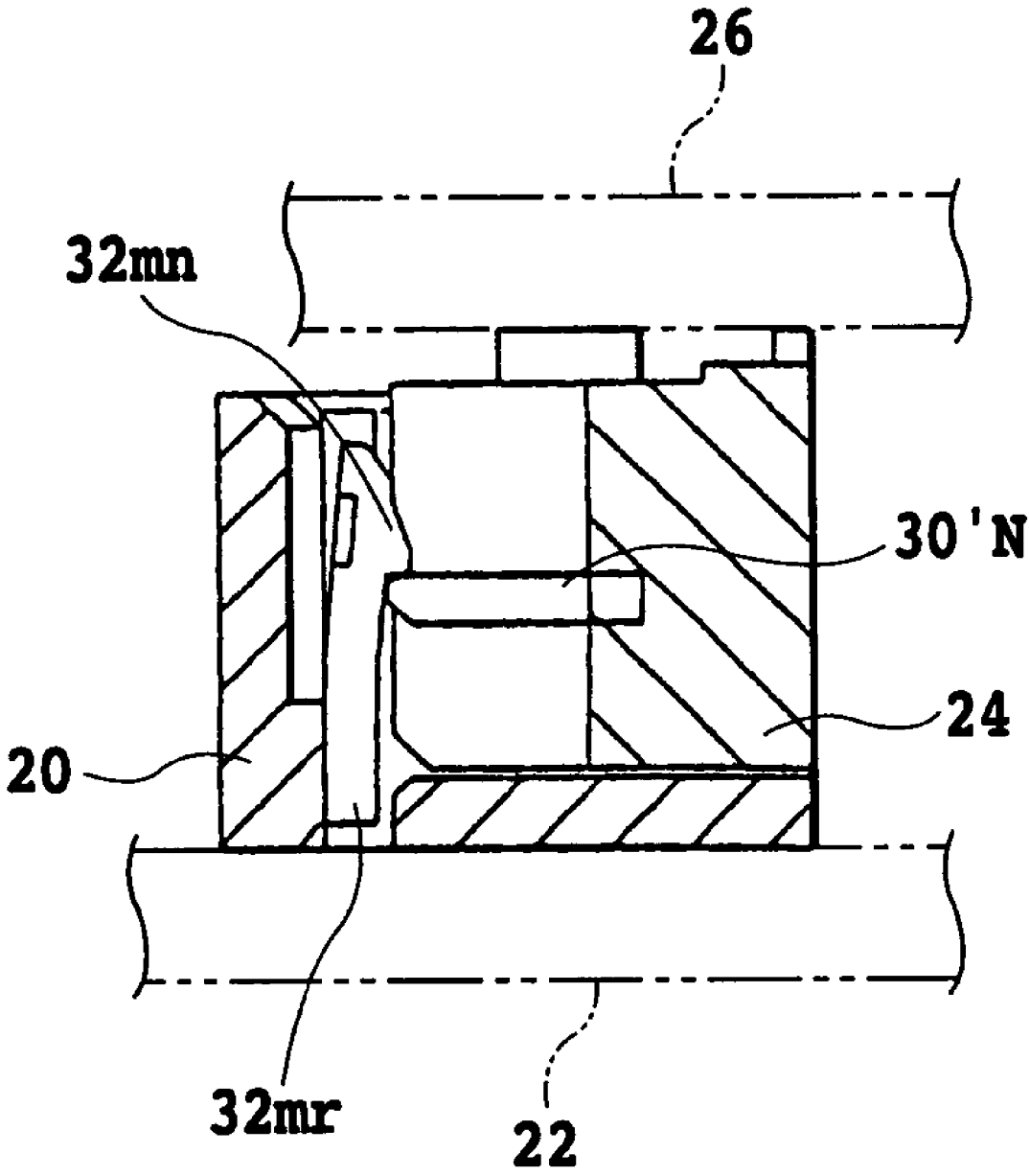
FIG. 8 is an enlarged partially sectional view of part of the embodiment shown in FIG. 7.
Figure 9:
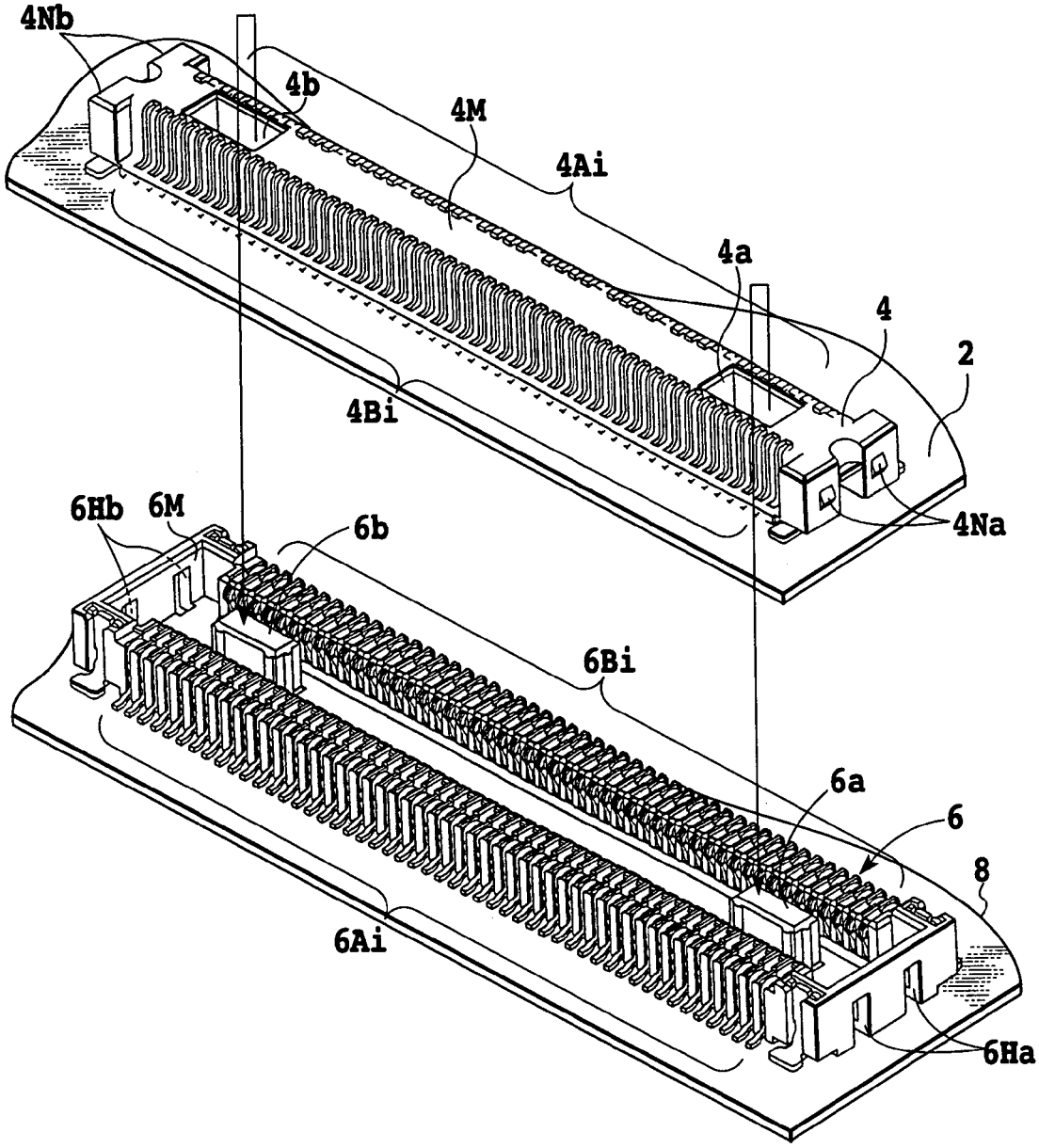
FIG.9 (PRIOR ART)
FIG. 9 is an exploded perspective view of a conventional connector for connecting circuit boards with each other.
Figure 10:
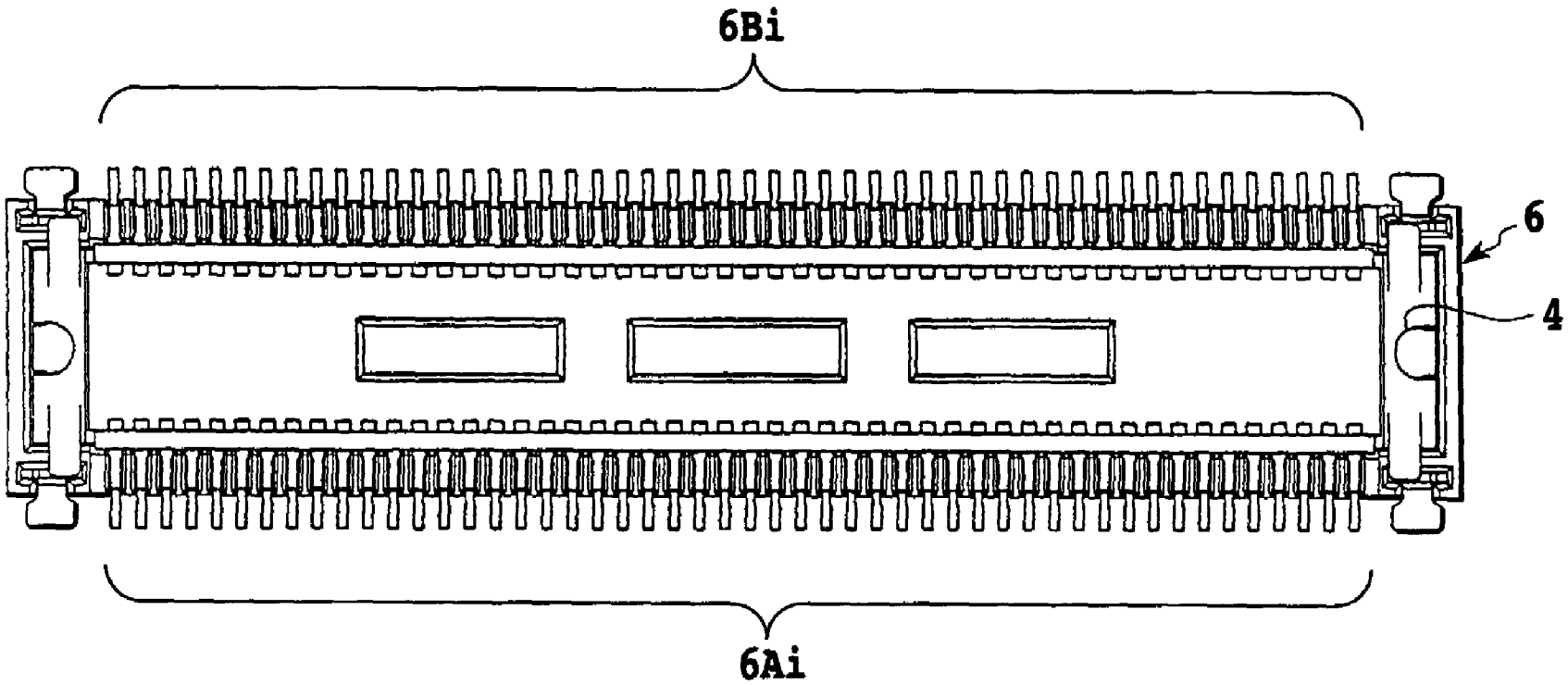
FIG.10 (PRIOR ART)
FIG. 10 is a plan view of a male connector section and a female connector section assembled to each other in an embodiment shown in FIG. 9.
Figure 11:
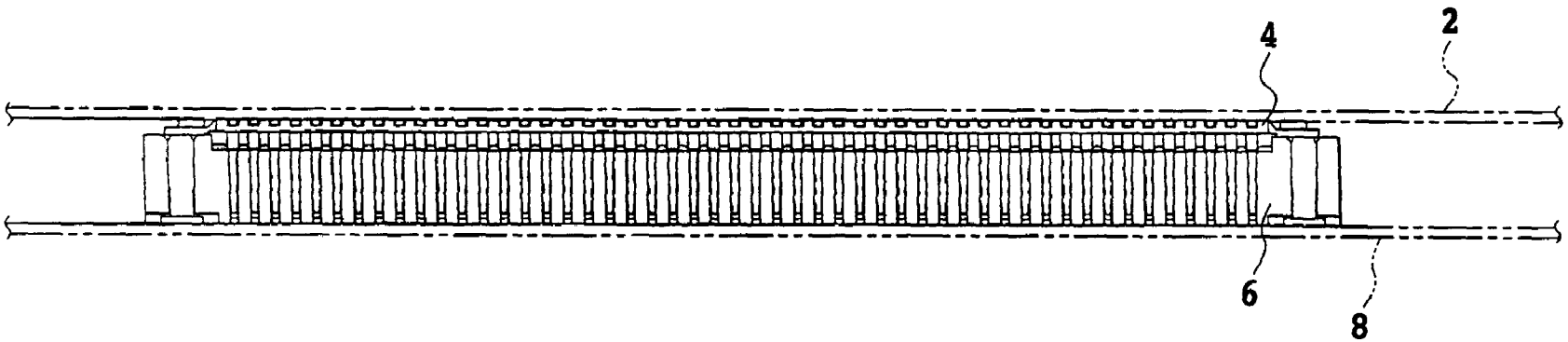
FIG.11 (PRIOR ART)
FIG. 11 is a front view of the assembly shown in FIG. 10.
Figure 12:
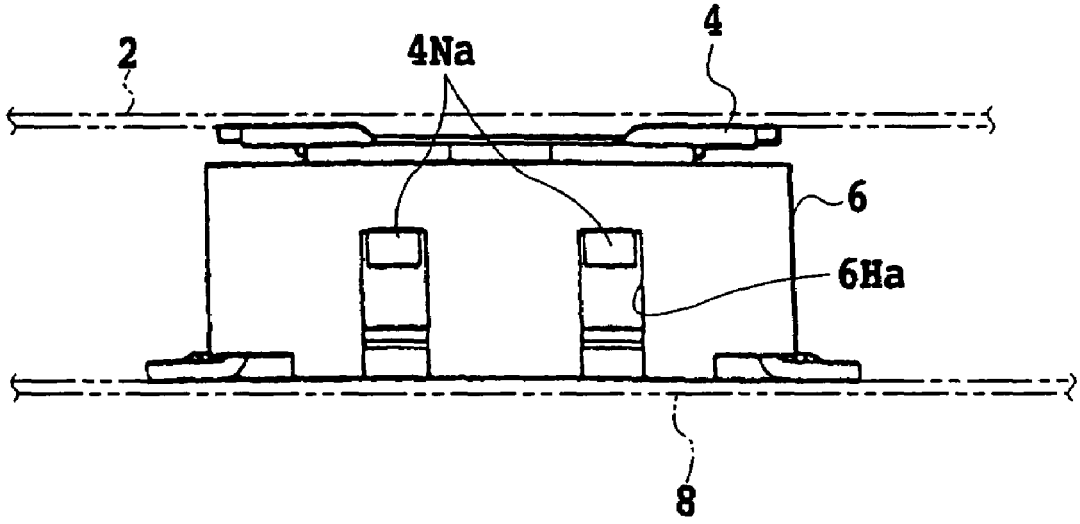
FIG.12 (PRIOR ART)
FIG. 12 is a side view of the assembly shown in FIG. 10.
Figure 13:
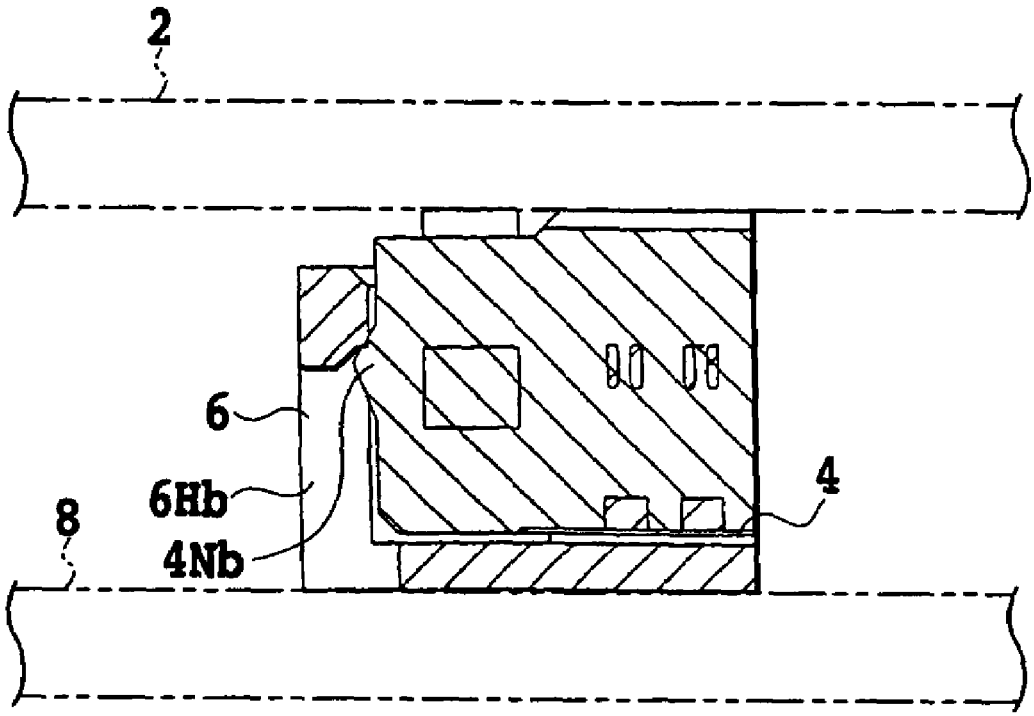
FIG.13 (PRIOR ART)
FIG. 13 is a partial sectional view of part of the assembly shown in FIG. 10.

Another embodiment of the inventive connector for connecting circuit boards is shown in FIGS. 7 and 8.

The holding fixture 30 is fixed to the base 24M by press-fitting the former into the recess formed in the interior of the male connector section 24 in the embodiment shown in FIG. 1. Instead, in the embodiment shown in FIGS. 7 and 8, nibs 30'N as the holding fixture engaged with the projections 32*mn* of the elastic pieces 32*mr* are solely embedded in one piece and fixed in the base 24M molded of resinous material.

In this regard, in FIGS. 7 and 8, the same reference numerals are used for denoting the same elements as in FIGS. 1 and 2, and the explanation thereof will be eliminated.

In this embodiment, the same operation and effect are obtainable as in the preceding embodiment.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A connector for connecting circuit boards with each other, comprising:

a first connector section disposed on a first circuit board and having contact terminals electrically connected to an electro-conductive layer of said first circuit board, and a second connector section disposed on a second circuit board provided in relation to said first circuit board and having contact terminals electrically connected to an electro-conductive layer of said second connector circuit board with said contact terminals of said second connector being connected electrically to said contact terminals of said first connector section, wherein when said first connector section is coupled to said second connector section, nibs of a fitting portion of a non-elastic metallic holding fixture provided in said first connector section, said fitting portion shaped to be bent so as to touch an inner surface of a recess in a base provided on said first circuit board, are latched with projections provided on an inner surface of an elastic metallic holding fixture provided in said second connector section to hold said first connector section on said second connector section, said nibs projecting away from said first connector section, said first connector section having leg sections which are bent alongside of said contact terminals to be fixed to said first circuit board at both ends of said fitting portion and said second connector section having leg portions which are bent alongside of said contact terminals to be fixed to said second circuit board and;

wherein a recess is formed for allowing a portion of an elastic piece being engaged in said second connector section to advance/retract at a base of said second connector section.

2. A connector as claimed in claim 1, wherein said nibs of said first connector section are embedded in one piece and fixed in said base of said first connector section.

3. A connector as claimed in claim 1, wherein said non-elastic metallic holding fixture and said elastic metallic holding fixture are formed in a thin sheet-like form separately from said base for supporting said contact terminals in said first or said second connector section.

* * * * *